US007543912B2

(12) United States Patent
Anderson, Jr. et al.

(10) Patent No.: US 7,543,912 B2
(45) Date of Patent: Jun. 9, 2009

(54) UNITARY WICK RETAINER AND BIASING DEVICE RETAINER FOR MICRO-FLUID EJECTION HEAD REPLACEABLE CARTRIDGE

(75) Inventors: James Daniel Anderson, Jr., Harrodsburg, KY (US); David Emerson Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 328 days.

(21) Appl. No.: 11/364,975

(22) Filed: Mar. 1, 2006

(65) Prior Publication Data

US 2007/0206074 A1 Sep. 6, 2007

(51) Int. Cl.
*B41J 2/14* (2006.01)

(52) U.S. Cl. ..... 347/49

(58) Field of Classification Search ..... 347/49, 347/85, 86, 87

See application file for complete search history.

(56) References Cited

U.S. PATENT DOCUMENTS

| | | | | |
|---|---|---|---|---|
| 5,589,862 | A * | 12/1996 | Ujita et al. | 347/87 |
| 6,155,678 | A * | 12/2000 | Komplin et al. | 347/86 |
| 6,460,984 | B1 * | 10/2002 | Matsumoto et al. | 347/86 |
| 6,766,817 | B2 | 7/2004 | da Silva | |
| 7,285,255 | B2 | 10/2007 | Kadlec et al. | |

* cited by examiner

*Primary Examiner*—Anh T. N. Vo
(74) *Attorney, Agent, or Firm*—Luedeka, Neely & Graham, PC

(57) ABSTRACT

A micro-fluid ejection head structure, method of sealing a removable fluid cartridge to a micro-fluid ejection head structure, and a cartridge carrier for removable fluid cartridges containing a micro-fluid ejection head structure. The micro-fluid ejection head structure includes a molded, multi-function member for attachment to the filter tower structure for a micro-fluid ejection head. The multi-function member has at least one biasing device retainer and at least one wick retainer positioned laterally adjacent to the biasing device retainer.

18 Claims, 4 Drawing Sheets

UNITARY WICK RETAINER AND BIASING DEVICE RETAINER FOR MICRO-FLUID EJECTION HEAD REPLACEABLE CARTRIDGE

TECHNICAL FIELD

The disclosure relates to micro-fluid ejection heads, and in particular structures suitable for improved assembly procedures for micro-fluid ejection head device components.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers and supplies for such printers in a more cost efficient manner than their competitors.

Micro-fluid ejection devices may be provided with permanent, semi-permanent, or replaceable ejection heads. Since the ejection heads require unique and relatively costly manufacturing techniques, some ejection devices are provided with permanent or semi-permanent ejection heads. In order to protect the ejection heads for long term use filtration structures are used between a fluid supply cartridge and the ejection heads to remove particles which may clog microscopic fluid flow paths in the ejection heads. Components attached to the filtration structures are provided to cooperate with removable fluid containers to provide fluid flow and fluid seals between the containers and the filtrations structures. Other components enable improved handling of the replaceable cartridges. For example, the fluid cartridges must be positively locked into a fixed position on the filter tower structures in order to feed fluid to the micro-fluid ejection heads without leaking. Accordingly, assembly of multiple components for multiple functions increases the cost of manufacture of the micro-fluid ejection devices. In view of the foregoing, exemplary embodiments of the disclosure provide a micro-fluid ejection head structure, method of sealing a removable fluid cartridge to a micro-fluid ejection head structure, and a cartridge carrier for removable fluid cartridges containing a micro-fluid ejection head structure. The micro-fluid ejection head structure includes a molded, multi-function member for attachment to the filter tower structure for a micro-fluid ejection head. The multi-function member has at least one biasing device retainer and at least one wick retainer positioned laterally adjacent to the biasing device retainer.

Another exemplary embodiment of the disclosure provides a method for sealing a removable fluid container to a fluid flow structure for a micro-fluid ejection head. According to the method a micro-fluid ejection head and filter tower structure in fluid flow communication with the micro-fluid ejection head are provided. A molded, multi-function member is attached to the filter tower structure. The multi-function member has at least one biasing device retainer, at least one wick retainer positioned laterally adjacent to the biasing device retainer, and a sealing surface for providing a fluidic seal between the removable fluid cartridge and the at least one wick retainer. The removable fluid cartridge is sealingly attached to the at least one wick retainer.

Yet another exemplary embodiment of the disclosure provides a fluid supply cartridge carrier having at least one removable fluid cartridge engagedly disposed in the cartridge carrier and a permanent or semi-permanent micro-fluid ejection head structure. The ejection head structure includes a micro-fluid ejection chip, a filtered fluid reservoir in fluid flow communication with the micro-fluid ejection chip, a filtration structure fixedly attached to the filtered fluid reservoir for flow of filtered fluid to the filtered fluid reservoir, and a multi-function component attached to the filtration structure. The multi-function component has at least one biasing device retainer and at least one wick retainer positioned laterally adjacent to the biasing device retainer. A coil spring is engaged in the biasing device retainer for biasing the removable fluid cartridge in the cartridge carrier away from the filter tower structure when the cartridge is disengaged with the cartridge carrier.

An advantage of the exemplary embodiments described herein is that a unitary component may be used in place of multiple components to enable enhanced assemble of components for micro-fluid ejection head structures. Use of a unitary component eliminates several steps required for assembling a wick retainer and cartridge biasing device in a cartridge carrier structure. The unitary component also reduces lateral tolerances required between adjacent filter towers to which the structure is attached.

BRIEF DESCRIPTION OF THE DRAWINGS

Further features and advantages of the disclosed embodiments may become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

In general, the disclosure is directed to micro-fluid ejection device structures and in particular to structures providing improved connections between removable fluid containers and permanent or semi-permanent micro-fluid ejection heads. For example, ink jet printers containing at least one permanent or semi-permanent micro-fluid ejection head desirably include a fluid container that is easily replaced by a user when the fluid in the container is depleted. Typically, ink jet printers include two or more micro-fluid ejection heads and thus may include fluid containers for each of the micro-fluid ejection heads.

Figure 1:
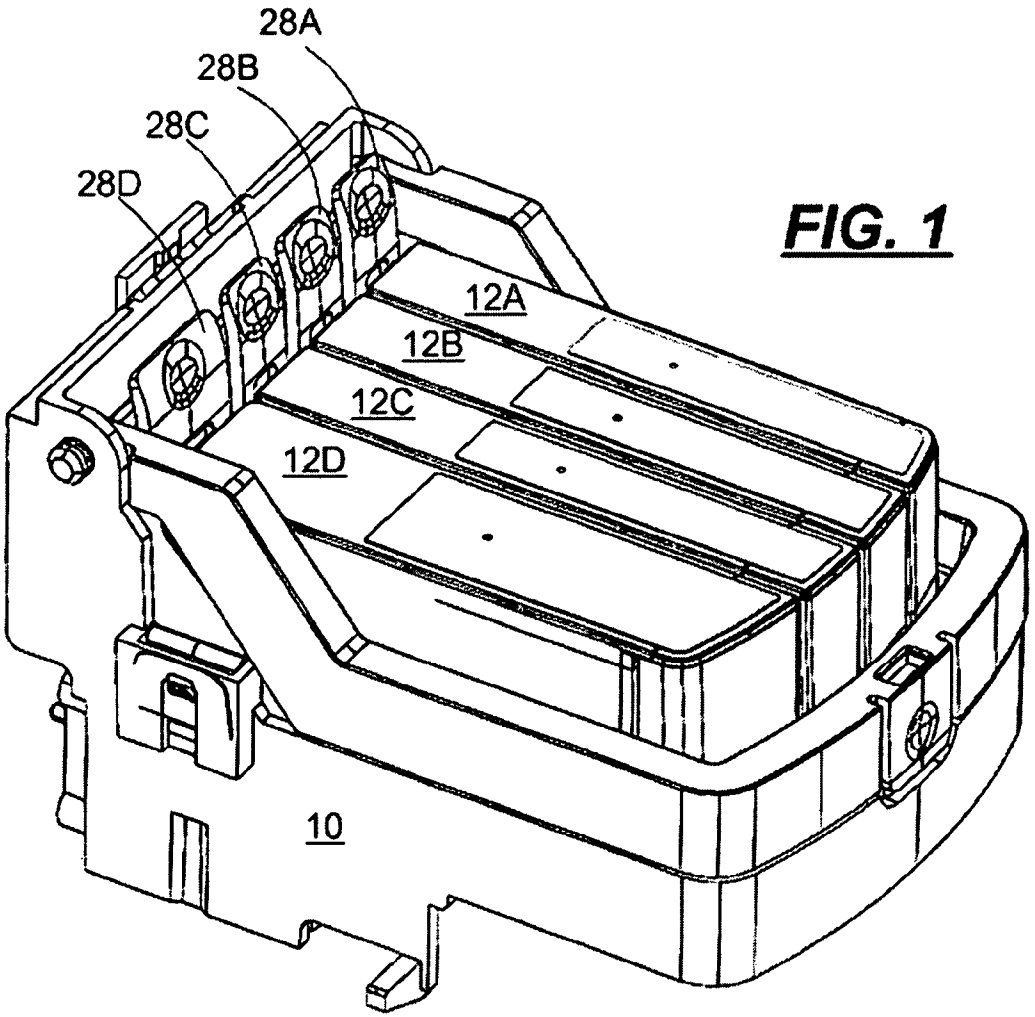
FIG. 1 is perspective view, not to scale, of a multi-cartridge carrier containing multiple cartridges for a micro-fluid ejection device.
Figure 2:
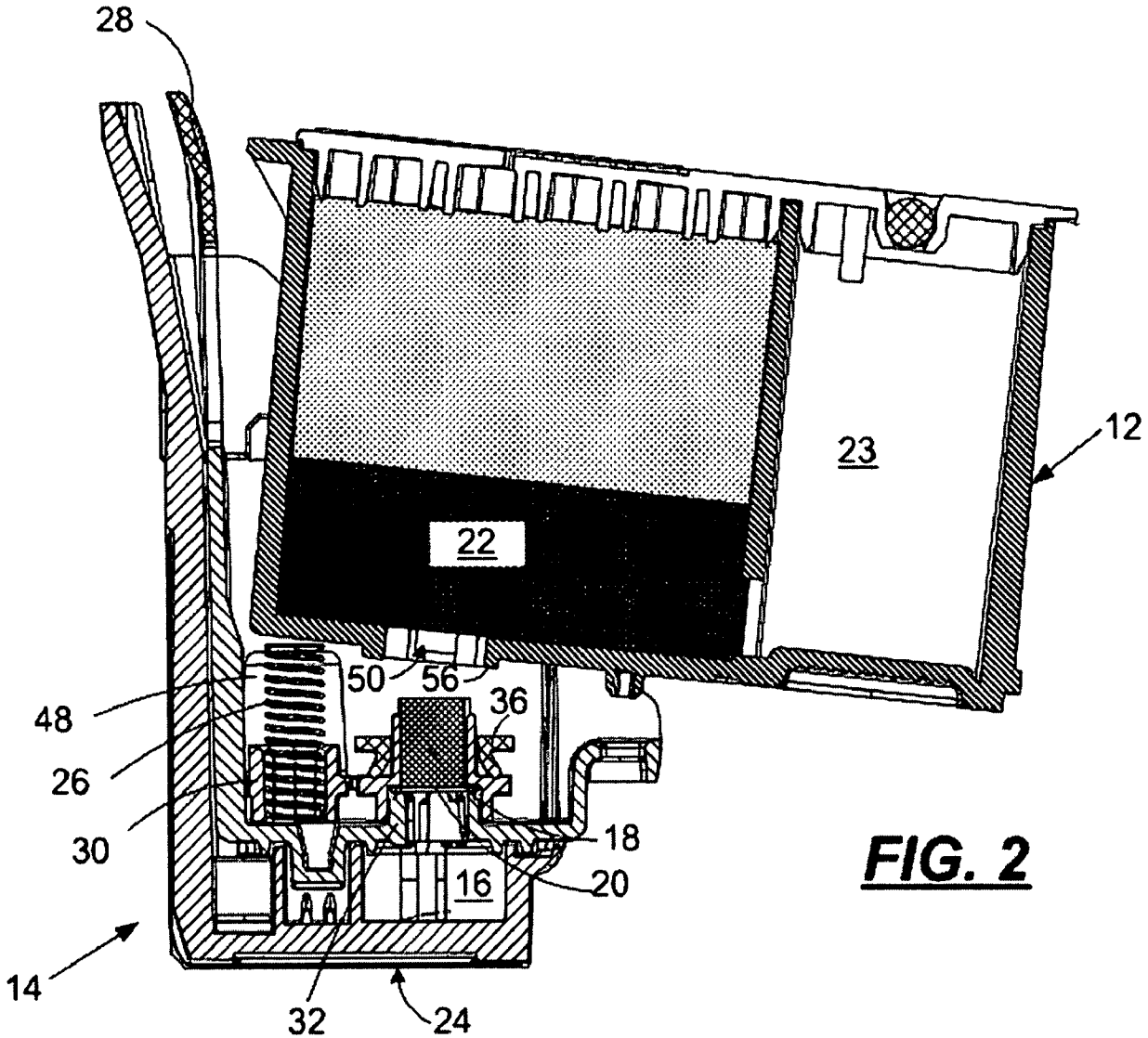
FIG. 2 is a cross-sectional view, not to scale, of a fluid supply container and a portion of a micro-fluid ejection head structure for connection to the fluid supply container.

By way of illustration, FIG. 1 provides a micro-fluid ejection head carrier 10 containing multiple, removable fluid containers 12. FIG. 2 is a cross-sectional view not to scale of a portion of a micro-fluid ejection head structure 14 and the removable fluid container 12. During replacement of the fluid container 12, it is very important that the fluid remaining in a filtered-fluid reservoir 16 in the micro-fluid ejection head structure 14 does not dry out when the container 12 is fluidly disconnected from the micro-fluid ejection head structure 14.

In one configuration of the micro-fluid ejection head structure 14, the filtered fluid reservoir 16 is protected by a wick 18 that is placed in fluid flow communications with a filtration device 20. The wick 18 slows evaporation of fluid from the fluid reservoir 16 when the fluid container 12 is not attached to the micro-fluid ejection head structure 14. The wick 18 also provides a fluidic connection between the filtration device 20 in the micro-fluid ejection head structure 14 and a capillary member 22 in the fluid container 12. The fluid container 12 may also include a liquid compartment 23 in fluid flow communication with the capillary member 22 to provide flow of fluid to the wick 18. In the micro-fluid ejection head structure 14, filtered fluid flows from the filtered fluid reservoir to a micro-fluid ejection head 24 for ejection onto a surface by the micro-fluid ejection head 24.

In order to aid in the removal of the replaceable fluid container 12 from the micro-fluid ejection head structure 14, a biasing device 26 such as a coil spring is provided laterally adjacent to the wick 18. When the fluid container 12 is disengaged from a latching device 28 on the carrier 10, the biasing device 26 biases the container 12 away from the wick 18. Accordingly, both the wick 18 and biasing device 26 are desirably retained in place on the micro-fluid ejection head structure 14, as described in more detail below.

Figure 3:
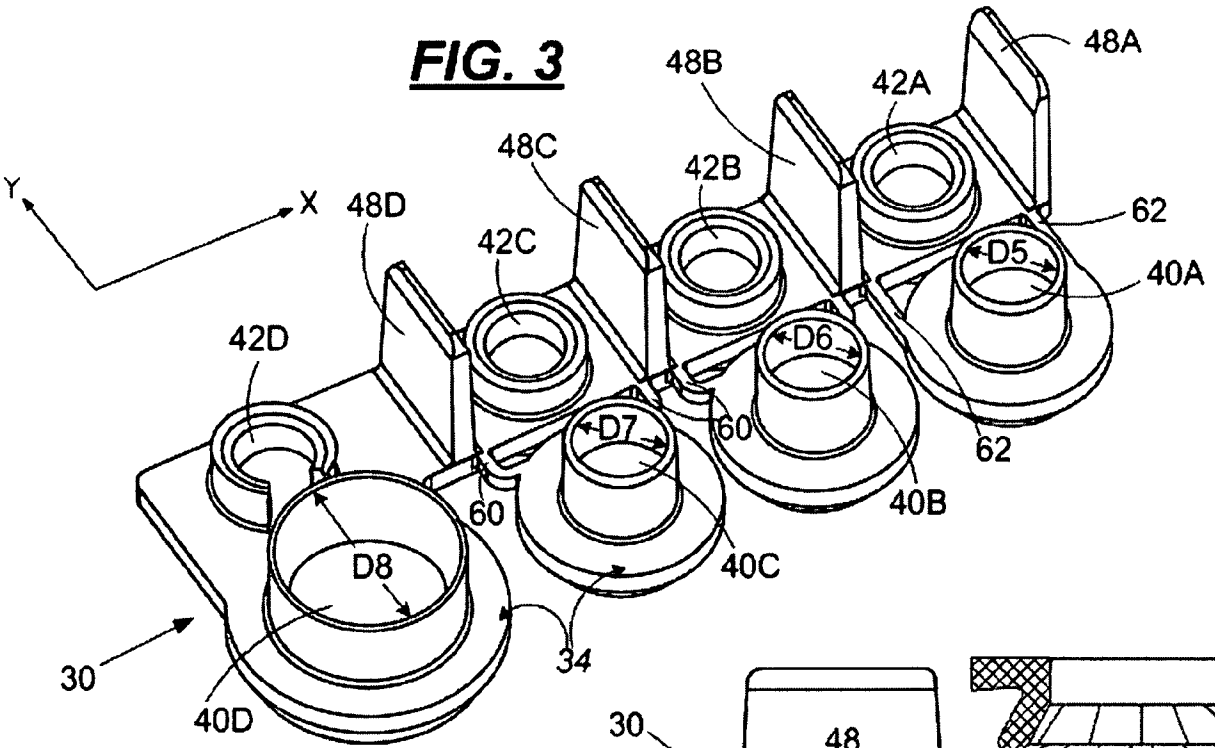
FIG. 3 is a perspective view, not to scale, of a multi-function structure according to an exemplary embodiment of the disclosure.
Figure 4:
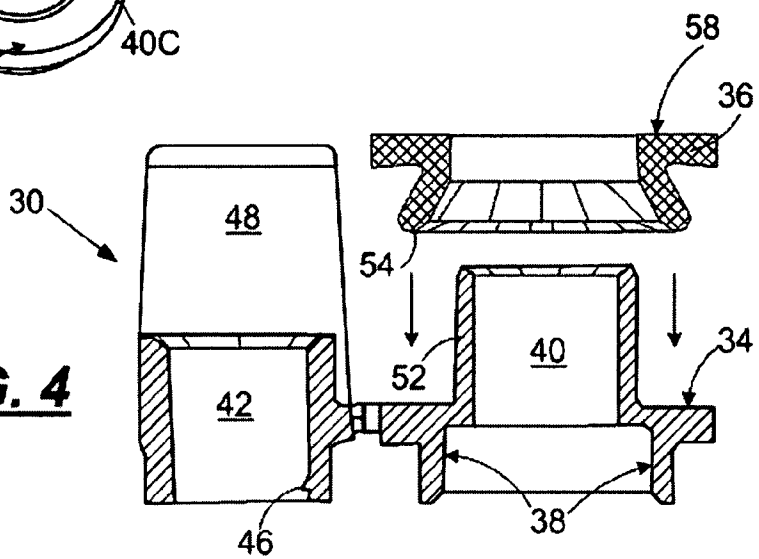
FIG. 4 is a cross-sectional exploded view, not to scale, of a portion of a multi-function structure and fluid sealing device according to the disclosure.
Figure 5:
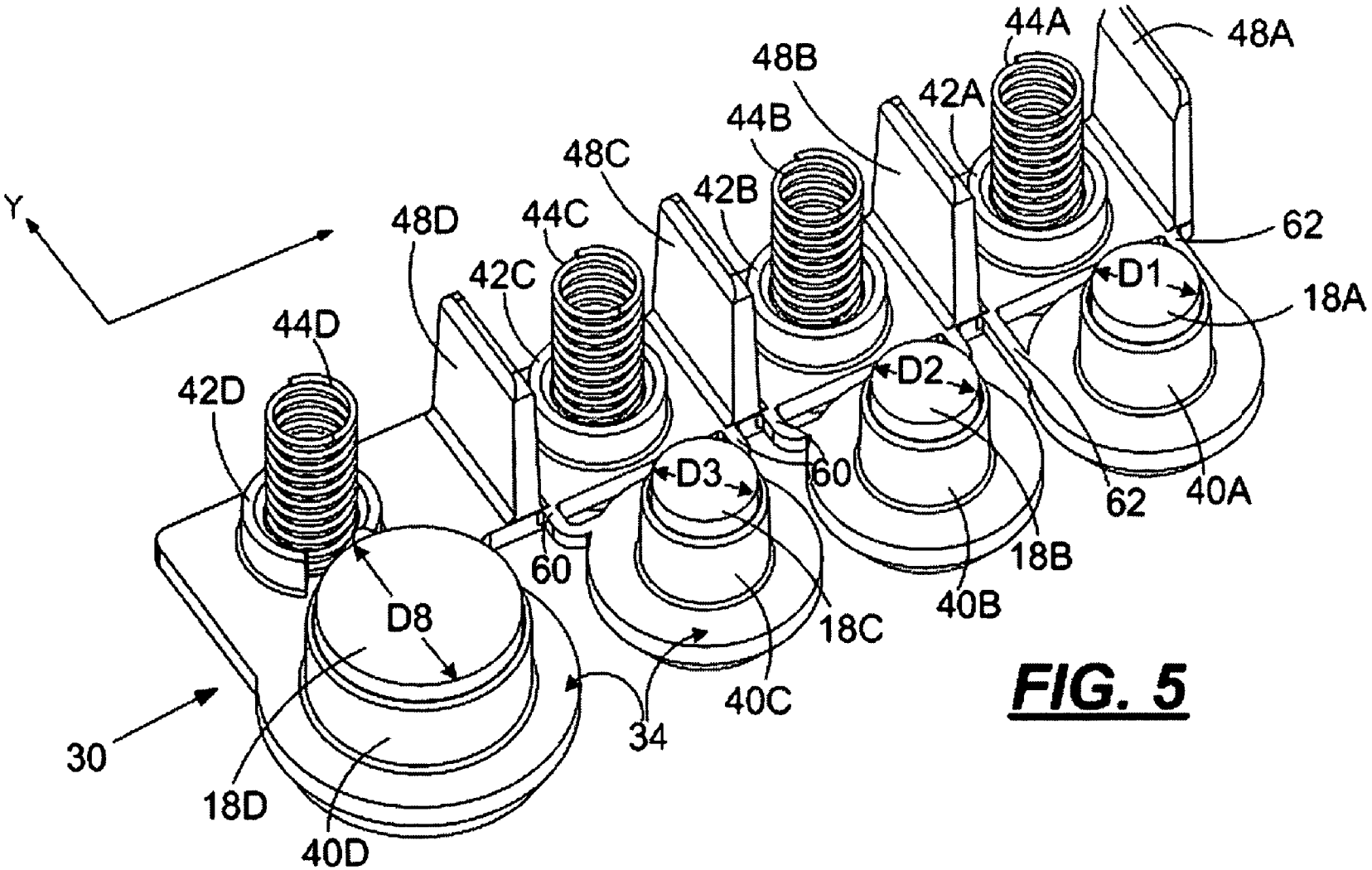
FIG. 5 is a perspective view, not to scale, of a multi-function structure according to an exemplary embodiment of the disclosure containing biasing devices and wicks.

With reference to FIGS. 3-5, details of a multi-function structure 30 for attachment to a filter tower component 32 of the micro-fluid ejection head structure 14 (FIG. 2) are illustrated. The multi-function structure 30 is desirably a unitary molded member that is attached to the filter tower component 32 in a manner that is sufficient to provide an air-tight and liquid-tight seal to the filter tower component 32. Accordingly, the multi-function structure 30 may be attached as by interference fitting, an adhesive, ultrasonic welding, laser welding, heat staking and the like. A particularly desirable method for attaching the multi-function structure 30 to the filter tower component 32 is by interference fitting the component 32 and structure 30 to one another.

As shown in FIG. 5, the multi-function structure 30 desirably retains the one or more wicks 18 and one or more biasing devices therein. As described in more detail below, the multi-function structure 30 also provides sealing surfaces 34 for making a fluidic seal between the fluid container 12 and the multi-function structure 30 as by use of a gasket 36 (FIGS. 2 and 4) or other suitable sealing material.

As shown in FIG. 2, the multi-function structure 30 is desirably press-fit over the filter tower component 32 with an interference fit that secures the structure 30 in place. In order to obtain an interference fit, the multi-function structure 30 may be molded of a soft grade of polyamide that may conform to the filter tower component 32 and provide a radial seal between an inside connecting surface 38 of the structure 30 and outside surfaces of the filter tower component 32. Since the structure 30 is made of a relatively soft material, the structure 30 will conform to the filter tower component 32 to provide an air-tight and liquid-tight seal. By providing an interference fit between the structure 30 and filter tower component 32, the structure may be readily installed on the filter tower component 32 during a manufacturing process without the need for adhesives, sealants, or gaskets.

As shown in FIGS. 3 and 5, an exemplary embodiment of the multi-function structure 30 includes four wick pockets 40A-40D for holding wicks 18A-18D in place over the filtration device 20 (FIG. 2). The wicks 18A-18D are capillary components that have slightly larger diameters D1-D4 than the diameters D4-D8 of the corresponding wick pockets 40A-40D so that the wicks are press fit inside the pockets 40A-40D. Accordingly, friction holds the wicks 18A-18D in place in the pockets 40A-40D when no fluid containers 12A-12D are present. When fluid containers 12A-12D are present, the downward force of the lower capillary members 22 in the containers 12A-12D press the wicks 18A-18D against the filtration devices 20 to maintain suitable fluid flow communication between the containers 12A-12D and the corresponding filtration devices 20.

Another feature of the multi-function structures 30 is the biasing device pockets 42A-42D that retain biasing devices 44A-44D therein for aid in ejecting the fluid containers 12A-12D when each fluid containers 12A-12D are unlatched from the latching devices 28A-28D (FIG. 1). Biasing devices 44A-44D, such as coil springs are retained in the pockets 42A-42D by a retaining device such as a barb 46 (FIG. 4) in each of the biasing device pockets 42A-42D. A retaining device such as the barb 46 may hook a coil of the biasing devices 44A-44D, in the case of coil spring biasing devices, to retain the biasing devices 44A-44D in the pockets 42A-42D. The barb 46 allows the biasing devices 44A-44D to compress freely in the pockets 42A-42D while preventing the biasing devices 44A-44D from disengaging from the pockets 42A-42D.

The multi-function structure 30 may also include rib members 48A-48D to aid in aligning fluid outlet ports on the containers 12A-12D with the wicks 18A-18D. The rib members 48A-48D are desirably aligned with the biasing device pockets 42A-42D.

As set forth above, the multi-function structure 30 includes the sealing surface 34 adjacent each of the wick pockets 40A-40D. The sealing surface 34 provides a face seal for the gasket 36 disposed between the sealing surface 34 and the container 12 as illustrated in FIG. 2. The gasket 36 may be press fit over the wick pocket 40 as shown in FIG. 4. As shown, the sealing surface 34 is a relatively flat ledge that is substantially perpendicular to walls 52 of the wick pocket 40 and provides a seal with a first edge 54 of the gasket 36. In order to provide a fluidic seal between the multi-function structure 30 and the containers 12A-12D, each of the containers 12A-12D includes a sealing rim 56 adjacent an exit port 50 of the containers 12A-12D (FIG. 2). The sealing rim 56 contacts a second edge 58 of the gasket 36 to provide a seal between the containers 12A-12D and the gasket 36.

In order to provide for positional variations in the filter tower components 32 of the ejection head structure 14, one or more of the wick pockets 40A-40D are flexibly attached laterally adjacent to the biasing device pockets 42A-42D as by webs 60 and 62. At least one of the wick pockets, such as wick pocket 40D is fixedly attached laterally adjacent to the biasing device pocket 42D to provide positive placement of the structure 30 in the x and y directions with respect to the ejection head structure 14. As shown in FIGS. 3 and 5, at least two of the remaining wick pockets, and desirably all three of the remaining three wick pockets 40A-40C are flexibly attached laterally adjacent to the corresponding biasing device pockets 42A-42D as by the webs 60 and 62. The webs 60 allow for positional variations in both the x and y directions for the wick pockets 40B and 40C. However, the webs 62 allow for a positional variation only in the x direction for the wick pocket 40A, which is used to control rotation of the structure 30 about the wick pocket 42D. The webs 60 and 62 enable sufficient flexibility so that each of the inside connecting surface 38A-38D may be radially sealed onto the filter tower components 32 even when there are tolerance variations in the locations of the filter tower components 32 with respect to the multi-function structure 30

Accordingly, the multi-component structure 30, as set forth above, may provide one or more of the following functions: wick retainers, biasing device retainers, fluidic seals between fluid containers and the structure 30, alignment between the containers and the structure 30, accommodates tolerance variations in micro-fluid ejection head structures 14, and easy assembly of micro-fluid ejection head components.

As described herein, the wicks 18 and the capillary members 22 in the fluid container 12 may be made of negative pressure inducing materials. The negative pressure inducing material may be a material such as a felted foam. For the purposes of this disclosure, a wide variety of negative pressure producing materials may be used to provide fluid flow from the containers 12 to the micro-fluid ejection head 24. Such negative pressure inducing materials may include, but are not limited to, open cell foams, felts, capillary containing materials, absorbent materials, and the like.

As used herein, the terms "foam" and "felt" will be understood to refer generally to reticulated or open cell foams having interconnected void spaces, i.e., porosity and permeability, of desired configuration which enable a fluid to be retained within the foam or felt and to flow therethrough at a desired rate for delivery of fluid to the micro-fluid ejection head 24. Foams and felts of this type are typically polyether-polyurethane materials made by methods well known in the art. A commercially available example of a suitable foam is a felted open cell foam which is a polyurethane material made by the polymerization of a polyol and toluene diisocyanate, The resulting foam is a compressed, reticulated flexible polyester foam made by compressing a foam with both pressure and heat to specified thickness.

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A micro-fluid ejection head structure, comprising:

a molded, multi-function member for attachment to a filter tower structure for a micro-fluid ejection head, wherein the multi-function member comprises at least one biasing device retainer and at least one wick retainer positioned laterally adjacent to the biasing device retainer, and wherein the at least one biasing device retainer comprises a cylindrical pocket containing a barb for retaining a coil spring in the pocket.

2. The micro-fluid ejection head structure of claim 1, wherein the multi-function member comprises at least three biasing device retainers and at least three wick retainers.

3. The micro-fluid ejection head structure of claim 2, wherein at least one of the wick retainers is flexibly attached laterally adjacent to at least one of the biasing device retainers.

4. The micro-fluid ejection head structure of claim 1, wherein the multi-function member comprises a unitary molded structure.

5. The micro-fluid ejection head structure of claim 1, wherein the at least one of wick retainer comprises a conduit in fluid flow communication with the filter tower structure for the micro-fluid ejection head.

6. The micro-fluid ejection head structure of claim 1, wherein the multi-function member is adhesively attached to the filter tower structure.

7. The micro-fluid ejection head structure of claim 1, wherein the multi-function member is frictionally attached to the filter tower structure.

8. The micro-fluid ejection head structure of claim 1, wherein the multi-function member is weldably attached to the filter tower structure.

9. The micro-fluid ejection head structure of claim 1, wherein the at least one wick retainer further comprises a sealing surface for providing a fluidic seal between a removable fluid cartridge and the at least one wick retainer.

10. A micro-fluid ejection head device comprising a micro-fluid ejection head, a filter tower structure in fluid flow communication with the micro-fluid ejection head, and the multi-function member of claim 1 attached to the filter tower structure.

11. A method for sealing a removable fluid container to a fluid flow structure for a micro-fluid ejection head, the method comprising the steps of:

providing a micro-fluid ejection head and a filter tower structure in fluid flow communication with the micro-fluid ejection head;

attaching a molded, multi-function member to the filter tower structure, wherein the multi-function member comprises at least one biasing device retainer that has a cylindrical pocket containing a barb for retaining a coil spring in the pocket, at least one wick retainer positioned laterally adjacent to the biasing device retainer, and a sealing surface for providing a fluidic seal between the removable fluid cartridge and the at least one wick retainer; and sealingly attaching the removable fluid cartridge to the at least one wick retainer.

12. The method of claim 11, wherein the multi-function member comprises at least three biasing device retainers and at least three wick retainers, further comprising sealingly attaching a removable fluid cartridge to each of the wick retainers.

13. The method of claim 11, wherein the multi-function member is frictionally attached to the filter tower structure.

14. The method of claim 11, wherein the multi-function member is adhesively attached to the filter tower structure.

15. The method of claim 11, wherein the multi-function member is weldably attached to the filter tower structure.

16. A fluid supply cartridge carrier comprising:

at least one removable fluid cartridge engagedly disposed in the cartridge carrier; and a permanent or semi-permanent micro-fluid ejection head structure, the ejection head structure comprising:

a micro-fluid ejection chip;

a filtered fluid reservoir in fluid flow communication with the micro-fluid ejection chip;

a filtration structure fixedly attached to the filtered fluid reservoir for flow of filtered fluid to the filtered fluid reservoir;

a multi-function component attached to the filtration structure, wherein the multi-function component comprises at least one biasing device retainer and at least one wick retainer positioned laterally adjacent to the at least one biasing device retainer; and the at least one biasing device retainer comprises a cylindrical pocket containing a barb that retains a spring for biasing the removable fluid cartridge in the cartridge carrier away from the filter tower structure when the cartridge is disengaged with the cartridge carrier.

17. The fluid supply cartridge carrier of claim 16, wherein the multi-function component comprises at least three biasing device retainers and at least three wick retainers.

18. The fluid supply cartridge carrier of claim 16, wherein the multi-function component is fixedly attached to the filtered fluid reservoir by a method selected from the group consisting of interference fitting, laser welding, ultrasonic welding, and heat staking.

* * * * *